United States Patent [19]

Satoh et al.

[11] Patent Number: 4,885,612

[45] Date of Patent: Dec. 5, 1989

[54] CLEANING DEVICE FOR AN IMAGE FORMING APPARATUS

[75] Inventors: Tsumori Satoh, Yokosuka; Yasushi Koichi, Yamato, both of Japan

[73] Assignee: Ricoh Company, Ltd., Tokyo, Japan

[21] Appl. No.: 254,863

[22] Filed: Oct. 7, 1988

[30] Foreign Application Priority Data

Oct. 8, 1987 [JP] Japan ..... 62-252413

[51] Int. Cl.[4] ..... G03G 21/0082

[52] U.S. Cl. ..... 355/305; 118/652; 15/256.52

[58] Field of Search ..... 355/305, 301, 296, 303, 355/306; 118/652; 430/125; 15/256.5, 256.51, 256.52

[56] References Cited

U.S. PATENT DOCUMENTS

| | | | |
|---|---|---|---|
| 4,110,034 | 8/1978 | Suzuki | 355/305 |
| 4,127,327 | 11/1978 | Rezanka | 355/305 |
| 4,355,886 | 10/1982 | Perez et al. | 355/305 |
| 4,402,103 | 9/1983 | Yanagawa et al. | 355/305 X |
| 4,420,242 | 12/1983 | Yamashita | 355/301 X |
| 4,470,694 | 9/1984 | Murakami et al. | 355/305 |
| 4,482,244 | 11/1984 | Yamazaki et al. | 355/305 |
| 4,483,611 | 11/1984 | Matsuura | 355/305 X |
| 4,515,467 | 5/1985 | Suzuki | 355/305 |
| 4,547,063 | 10/1985 | Stange | 355/305 |
| 4,571,070 | 2/1986 | Tomita | 355/305 |
| 4,627,717 | 12/1986 | Thompson | 355/305 |
| 4,641,956 | 2/1987 | Seanor | 355/305 X |

*Primary Examiner*—R. L. Moses

*Attorney, Agent, or Firm*—Oblon, Spivak, McClelland, Maier & Neustadt

[57] ABSTRACT

A cleaning device for an image forming apparatus which develops an electrostatic latent image provided on an image carrier with toner, transfers the resulting toner image to a transfer material, and cleans the image carrier to remove toner remaining thereon and, more particularly, a cleaning device of the type using a carrier retaining member which retains carrier thereon by a magnetic force. Carrier particles which form a magnet brush have volume resistivity of lower than $10^{10}$ Ω.cm while toner particles have a dielectric constant of smaller than 3.7.

10 Claims, 5 Drawing Sheets

CLEANING DEVICE FOR AN IMAGE FORMING APPARATUS

BACKGROUND OF THE INVENTION

The present invention relates to a cleaning device for an image forming apparatus of the type developing an electrostatic latent image formed on an image carrier with toner, transferring the resulting toner image onto a transfer material, and cleaning the image carrier to remove remaining toner. More particularly, the present invention is concerned with a magnet brush type cleaning device which includes an exclusive member for retaining carrier thereon by a magnetic force.

There has been known an image forming apparatus which develops an electrostatic latent image provided on a photoconductive element or similar image carrier with toner, transfers the resulting toner image onto a transfer material, and repeats such a sequence of steps thereafter. A prerequisite with such an apparatus is that toner remaining on the image carrier after the transfer of toner image be removed to prepare the image carrier for another image forming cycle. A cleaning device of the type using a magnet brush has been proposed for removing the remaining toner, as disclosed in Japanese Patent Publication No. 48-37382 and Japanese Laid-Open Patent Publication (Kokai) Nos. 56-51768 and 50-75044 by way of example. This type of cleaning device includes a carrier retaining member in the form of a cleaning sleeve and a plurality of magnets which are accommodated in the carrier retaining member. A bias voltage opposite in polarity to the charge of remaining toner is applied to the carrier retaining member to charge carrier which is deposited on the retaining member, whereby the remaining toner whose polarity is opposite to that of the carrier is adhered to the carrier by an electric force and thereby removed from the image carrier. Such a magnet brush type cleaning device is advantageous over a fur brush type cleaning device, blade type cleaning device and others in that it does not noticeably damage the image carrier and preserves the cleaning effect over a long period of time.

To enhance the cleaning effect of a magnetic brush type cleaning device, it is preferable that the toner remaining on the image carrier be attracted by an intense electric force toward the carrier. A possible approach for achieving such an object is reducing the volume resistivity of the carrier which is retained on the carrier retaining member or cleaning sleeve, more specifically the volume resistivity of at least the surface portions of the individual carrier particles, to smaller than $10^{10}$ Ω.cm. Then, the bias voltage applied to the cleaning sleeve will increase the effective bias at the tip of the carrier and thereby intensify the electric field between the carrier and the image carrier. In this condition, the toner on the image carrier and existing in such an electric field is attracted by an intense electric force toward the carrier. This kind of approach is disclosed in Japanese Laid-Open Patent Publication (Kokai) No. 50-75044. However, when carrier having such low resistance is used and deposited with a larger amount of charge, there is a fear that the charge on the carrier is injected into the toner which is adhered to the carrier, inverting the polarity of charge of the toner. This causes the carrier to repulse the toner away from the cleaning sleeve toward the image carrier and thereby lowers the cleaning ability.

In light of the above, it has been customary to use carrier whose volume resistivity is greater than $10^{10}$ Ω.cm so as to increase the amount of frictional charge developing between the carrier and the toner. The charge deposited on such carrier serves to attract the remaining toner on the image carrier toward the carrier. With this kind of scheme, however, it is impossible to achieve a sufficient cleaning effect. Moreover, in order that the amount of frictional charge between the carrier and the toner may be increased, the rotation speed of the cleaning sleeve and/or that of the magnets disposed in the cleaning sleeve has to be increased to intensity the agitating force which acts on the carrier and toner. Increasing the rotation speed as mentioned subjects the carrier to excessive external forces and thereby aggravates the deterioration of the carrier, resulting in poor cleaning ability.

SUMMARY OF THE INVENTION

It is therefore an object of the present invention to provide a magnet brush type cleaning device which maintains a satisfactory degree of cleaning effect for a long time despite the use of carrier having relatively low resistance.

It is another object of the present invention to provide a generally improved cleaning device for an image forming apparatus.

In accordance with the present invention, in a cleaning device for an image forming apparatus which develops an electrostatic latent image formed on an image carrier with toner to produce a toner image, transfers the toner image to a transfer material, and cleans the image carrier to remove toner remaining on the image carrier after the image transfer, the cleaning device comprises a carrier retaining member magnetically retaining carrier which forms a magnet brush and being located to face the image carrier such that the carrier attracts by an electric force the toner remaining on the image carrier, and voltage applying means for applying to the carrier retaining means a bias voltage which is opposite in polarity to a charge deposited on the remaining toner to be removed. Particles of the carrier which forms the magnet brush individually have volume resistivity of lower than $10^{10}$ Ω.cm while particles of the toner individually have a dielectric constant of smaller than 3.7.

BRIEF DESCRIPTION OF THE DRAWINGS

The bove and other objects, features and advantages of the present invention will become more apparent from the following detailed description taken with the accompanying drawings in which.

DESCRIPTION OF THE PREFERRED EMBODIMENT

Figure 1:
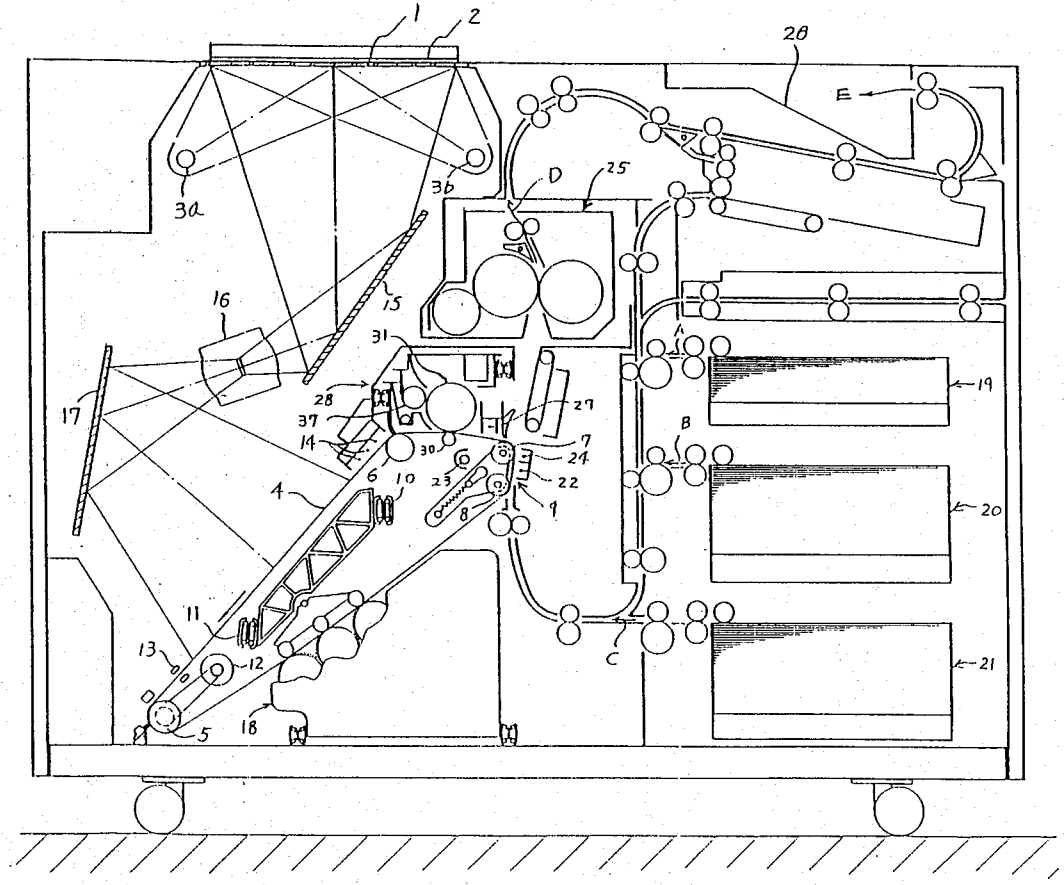
FIG. 1 is a schematic section showing a copier in which a cleaning device embodying the present invention is installed.

Referring to FIG. 1 of the drawings, an electronic copier which is representative of a family of image forming apparatuses and equipped with a cleaning device embodying the present invention is shown. To better understand the present invention the outline of the copier shown in FIG. 1 will be described first.

In the figure, the copier includes a glass platen 1 on which an original document 2 is laid. Flash lamps 3*a* and 3*b* are instantaneously turned on to illuminate the entire surface of the document 2. Imagewise light reflected from the document 2 is focused onto a photoconductive element 4 in the form of an endless belt which serves as an image carrier. The belt 4 is passed over a drive roller 5 and three driven rollers 6, 7 and 8 and constantly biased by a spring to be held under predetermined tension. The belt 4 constitutes a photoconductive element unit together with other structural elements. The photoconductive element unit is movable into and out of the copier on and along upper and lower slide rails 10 and 11. Shafts on which various rollers of the photoconductive element unit are mounted are journalled to a front and a rear side wall, not shown, of the unit. A drive motor 12 is supported by the rear side wall to controllably drive the belt 4 via the drive roller 5.

In operation, the drive motor 12 and a main motor, not shown, are energized to start operating sheet feed devices 19, 20 and 21, a cleaning device 28 and others which will be described. At the same time, the belt 4 is driven in a direction indicated by an arrow in the figure. As soon as a mark sensor 13 senses a synchronizing mark, not shown, which is provided on a side edge portion of the belt 4, various image forming devices arranged around the belt 4 begin to operate at their predetermined timings. First, a charger 14 charges the surface of the belt 4 to a predetermined polarity. In the illustrative arrangement, the belt 4 is implemented by an organic semiconductor (OPC) and, therefore, the belt 4 is charged to a negative polarity. The imagewise light from the document 2 the entire surface of which has been illuminated by the flash lamps 3*a* and 3*b* as previously stated is focused onto the charged surface of the belt 4 via a first mirror 15, a lens 16 and a second mirror 17. A latent image provided on the belt 4 by such imagewise exposure is brought to a developing unit 18 as the belt 4 is rotated. The developing unit 18 develops the latent image with toner to produce a toner image. In this particular copier, the toner is charged to positive polarity which is opposite to the negative polarity of the latent image on the belt 4 and, hence, the toner is electrostatically deposited on the latent image to develop it.

A transfer material (usually a paper sheet) is fed from one of the sheet feed devices 19, 20 and 21 each storing transfer materials of a different size toward a transfer station 9 as indicated by an arrow A, B or C. At the transfer station 9, the paper sheet is subjected to the discharging operation of a transfer charger 22 on one surface thereof and is illuminated by a discharging lamp 23 which is located inside the belt, whereby the toner image is transferred from the belt 4 to the paper sheet. Then, the paper sheet with the toner image is separated from the belt 4. In the case where the roller 7 has a relatively small diameter such as 26 millimeters, the paper sheet may be separated from the belt 4 by curvature which is ascribable to the elasticity of the paper sheet. In the illustrative arranagement, however, use is made of an AC separation charger 24 for the purpose of enhancing sure separation. The paper sheet separated from the belt 4 is passed through a fixing device 25 (arrow D) to fix the toner image thereon and then driven out of the copier onto a tray 26 as indicated by an arrow E. A precleaning charger 27 uniformly charges the surface of the belt 4, and the toner remaining on the belt 4 is removed by the cleaning unit 28 from the belt surface. The belt 4 is now ready to form the next toner image thereon.

Figure 2:
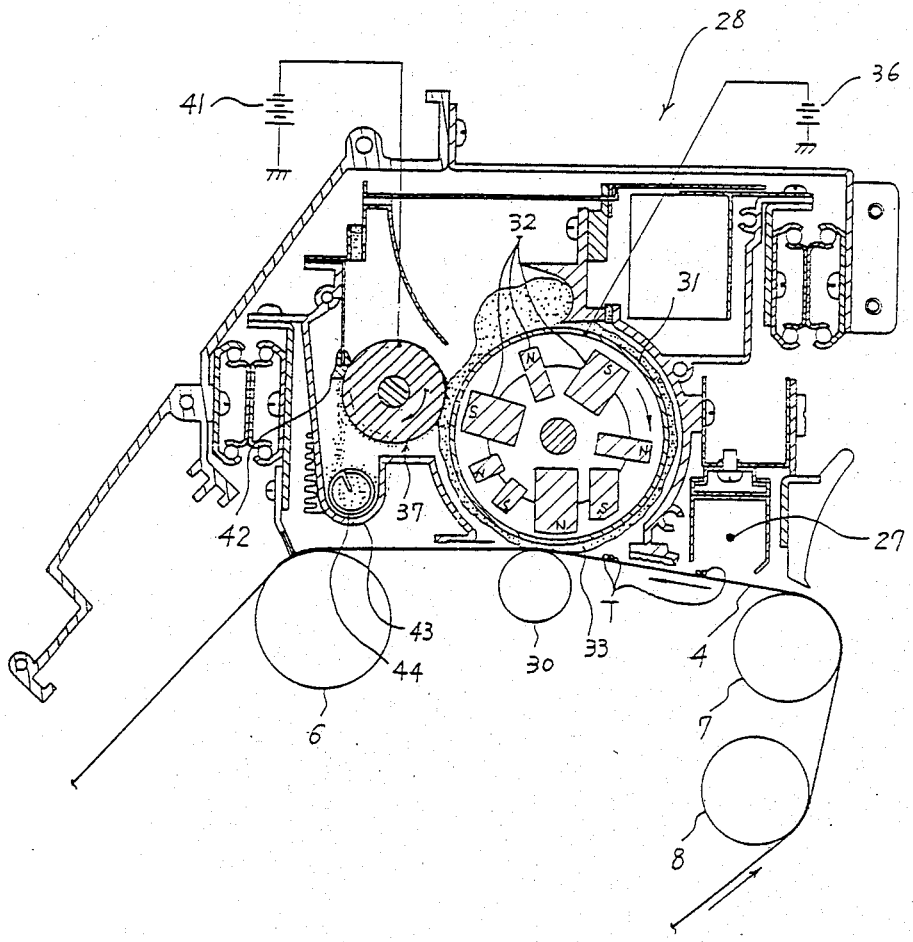
FIG. 2 is an enlarged section showing details of the cleaning device of the copier shown in FIG. 1.

In FIG. 2, the toner remaining on the belt 4 and moved away from the charger 27 is shown in a sketch and designated by the character T. The toner particles may individually have a diameter of about 10 to 20 microns, as well known in the art. Assume that the remaining toner T on the belt 4 is positively charged by the charger 27 by way of example. More specifically, the surface of the belt 4 is charged by the corona discharge of the charger 27 to a potential of +100 volts to +120 volts, for example. The toner T thus positively charged is brought to the cleaning device 28. The uniform charge deposited on the belt 4 by the precleaning charger 27 is significant for the following reason. Since the toner is charged by AC by the separation charger 24, it is not uniform with respect to the polarity of charge. This, coupled with the fact that the transfer condition is susceptible to the thickness of the paper sheet and various ambient conditions, the polarity of toner which has not reached the charger 27 is not uniform. Meanwhile, when a paper sheet fails to reach the transfer station 9 due to some trouble occurred during transport, the entire toner on the belt 4 reached the transfer station 9 is not transferred and is negatively charged by the transfer charger 22. In such a case, too, the toner can be positively charged by the charger 27.

As shown in FIG. 2, the cleaning device 28 includes a backup roller 30 located at the back of the belt 4 and a cleaning sleeve 31 which faces the backup roller 31 with the intermediatey of the belt 4, the cleaning sleeve 31 serving as a carrier retaining member. The cleaning sleeve 31 is rotatable clockwise as viewed in FIG. 2. A suitable number of magnets 32 are accommodated in the cleaning sleeve 31 and fixed in place. The magnets 32 are arranged such that the N and S poles alternately appear on their ends which face the inner periphery of the sleeve 31. Carrier in the form of particles each having a diamemter of 120 microns, for example, are deposited on the surface of the sleeve 31. Toner particles are electrostatically adhered to the carrier particles beforehand. Such carrier and toner are sometimes collectively referred to as a cleaning agent. The sleeve 31 is made of a conductive non-magnetic material such as aluminum.

Figure 3:
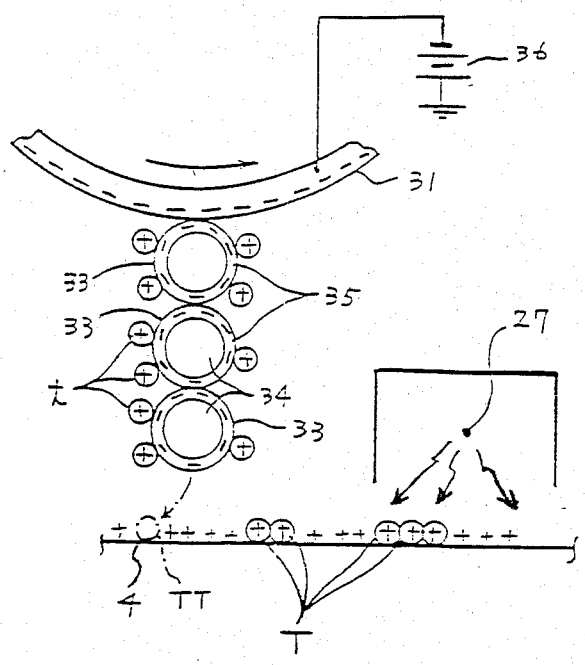
FIG. 3 schematically shows a cleaning procedure.

The individual particles of the carrier are shown in FIG. 3 and designated by the reference numeral 33. As shown, each carrier particle consists of a core 34 which is implemented by a magnetic material such as iron, and a coating 35 deposited on the core 34. In FIG. 3, the toner adhered to the carrier 33 on the cleaning sleeve 31 is labeled t in distinction from the remaining toner T on the belt 4. The carrier 33 made of a magnetic material is retained on the sleeve 31 by the magnetic forces of the magnets 32, FIG. 2, to form a magnet brush. As the sleeve 31 is rotated clockwise as viewed in FIG. 2, such a magnet brush is transported clockwise on the sleeve 31. The carrier on the sleeve 31 may or may not make contact with the belt 4 when it faces the belt 4. In this example, both the toner T and the toner t are non-magnetic. Voltage applying means is implemented as a −170-volt power source 36 in this particular example and adapted to apply a negative bias voltage which is opposite in polarity to the toner T having moved away from the charger 27. Hence, the carrier particles 33 on the cleaning sleeve 31 is negatively charged (see FIG. 3).

When the remaining toner T on the belt 4 moves away from the precleaning charger 27 to the proximity of the cleaning sleeve 31, it is electrically attracted by the carrier 33 because the toner T has been positively charged and the carrier 33 has been negatively charged. As a result the toner T is separated from the belt 4 and adheres to the carrier 33 instead. More specifically, the toner T is electrostatically transfered to the carrier 33 by the electric field which is developed between the sleeve 31 or carrier 33 and the belt 4. Further, in the illustrative arrangement, the carrier 33 on the sleeve 31 and the toner t are agitated and mixed together by the rotation of the sleeve 31 so that the toner t is frictionally charged to positive polarity. Since the toner t and the carrier 33 are caused to move while changing their relative position, the charge deposited on the carrier due to the friction further enhances the attraction of the toner T by the carrier 33.

As shown in FIG. 2, the toner T transferred from the belt 4 to the carrier is transported toward a toner collecting roller 37 together with the carrier as the sleeve 31 is rotated. The roller 37 is made of metal or similar conductive material, as well known in the art. A negative bias (e.g. −300 volts) higher than the voltage applied to the cleaning sleeve 31 is applied from a power source 41 to the roller 37. The roller 37 is rotated in a suitable direction such as a clockwise direction. Such a voltage difference between the roller 37 and the sleeve 31 develops an electric field between the carrier 33 on the sleeve 31 and the roller 37. Assume that a voltage of −170 volts and a voltage of −300 volts are applied to the sleeve 31 an the roller 37, respectively, as stated earlier. Then, an electric field of 130 volts, i.e, difference between −170 volts and −300 volts is developed between the sleeve 31 and the roller 37. Hence, the toner deposited on the positively charged carrier is electrically separated from the carrier to adhere to the roller 37. The toner collected by the roller 37 is scraped off by a blade 42 which is held in contact with the surface of the roller 37, then dropped into a receptacle 43 disposed below the roller 37, and then carried away by a transport coil 44. At this instant, not all the toner on the carrier 33 is collected by the roller 37, i.e., a predetermined amount of toner is moved away from the roller 37 whle being adhered to the carrier 33. This achievable by, for example, adequately selecting the intensity of electric field which is developed between the roller 37 and the sleeve 31. This part of toner allowed to remain on the carrier 33 turns into the toner $\epsilon$ which forms a part of the cleaning agent as previously stated. By the friction of the toner t and carrier 33, the carrier 33 is charged to in turn attract the remaining toner T. In this manner, a predetermined amount of toner t is constantly retained on the sleeve 31 in addition to the carrier 33 so as to frictionally charge the carrier 33.

As described above, the sleeve 31 is located to face the belt 4 such that the carrier 33 retained in the form of a magnet brush on the cleaning sleeve 31 attracts the toner T on the belt 4 by an electric force, thereby cleaning the belt 4. As previously discussed, as the volume resistivity of each carrier particle on the sleeve 31, more precisely at least the surface portion of each carrier particle (volume resistivity of the coating 35 in this example), decreases, the charge due to the voltage applied to the sleeve 31 more effectively extends to the carrier particles which are positioned at the radially outermost end on the sleeve 31. This intensifies the electric field between the carrier 33 and the belt 4 and thereby increases the effective bias at the outermost end of the carrier. As a result, the toner T on the belt 4 is attracted toward the carrier 33 by a more intense electric field to enhance the cleaning effect. Stated another way, for a given bias voltage applied to the sleeve 31, the voltage drop at the outermost end of the magnet brush (lower end of the carrier 33 located in the lowermost part as shown in FIG. 3) is reduced as the electric resistance of the carrier 33 is reduced.

Figure 4:
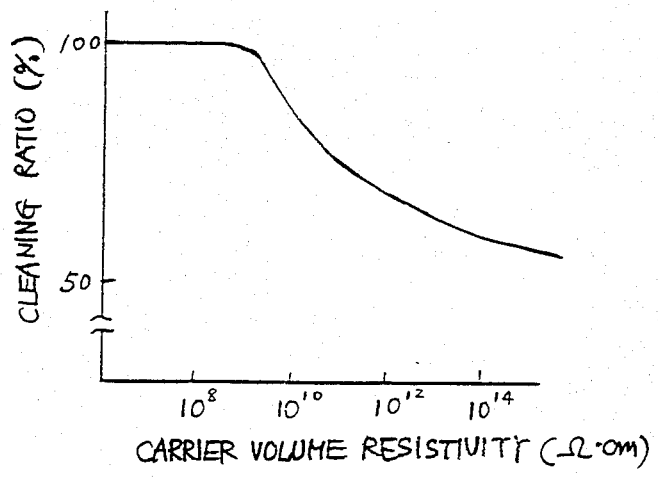
FIG. 4 is a graph representative of a relationship between the volume resistivity of carrier and the cleaning ratio attainable therewith.

FIG. 4 shows a graph representative of a relationship between the volume resistivity of the carrier 33 and the cleaning ratio achievable with the belt 4. It will be seen that the cleaning ratio is increased as the volume resistivity becomes lower than $10^{10}$ Ω.cm, especially lower than $10^{8}$ Ω.cm, and is sharply decreased as the volume resistivity becomes higher than $10^{10}$ Ω.cm. It is to be noted that the cleaning ratio is obtained in terms of percentage by the following expression $$\frac{X - Y}{X} \times 100$$

where X is the amount of remaining toner T (mg/cm$^2$) coming into the cleaning unit 28 and Y is the amount of toner T (mg/cm$^2$) coming out of the cleaning unit 28 without being removed. In the graph of FIG. 4, that part of toner which may be returned to the belt 4 as with a prior art cleaning unit is neglected.

The volume resistivity of the carrier 33 should preferably be relatively low, as discussed above. However, excessively low volume resistivity would obstruct the frictional charging of the carrier 33 and toner t on the cleaning sleeve 31 to thereby lower the cleaning effect associated with the remaining toner T. A preferable range of volume resistivity is therefore substantially $10^{6}$ Ω.cm to $10^{10}$ Ω.cm, especially $10^{6}$ Ω.cm to $10^{8}$ Ω.cm.

With a prior art cleaning unit, when the carrier 33 has a relative low volume resistivity and therefore increases the amount of negative charge deposited on that part of the carrier 33 which is located at the outermost end of the sleeve 31, the negative charge is sometimes injected back into the positively charged toner particles T which has been transferred from the belt 4 to the carrier 33. Presumably, such charge injection is ascribable to the toner t which tends to have the same potential as the carrier 33, i.e., it tends to become stable while moving on and along the surface of the carrier 33. In such a condition, the toner t becomes the same as the carrier 33 with respect to polarity and, therefore, the toner t and the carrier 33 repulses each other. Consequently, the toner T once adhered to the carrier 33 is returned to the belt 4, as indicated by a dash-and-dot line in FIG. 3. Such a return of the toner T to the belt 4 is especially aggravated when the toner is non-magnetic and therefore not susceptible to the force of the magnets 32 as in the illustrative arrangement. The toner T returned to the belt 4 lowers the cleaning efficiency in proportion to its amount.

As described above, the use of carrier having relatively low resistance is undesirable when it comes to a prior art cleaning device because it brings about the so-called reverse development. More specifically, despite that the ability to remove remaining toner is satisfactory as shown in FIG. 4, the use of low resistance carrier with a prior art cleaning device causes a part of toner adhered to the carrier to be returned to the belt 4.

This occurrence becomes more prominent as the resistance of the carrier decreases.

In light of the above, we conducted a series of researches and experiments in search of a condition which allows the belt 4 to be cleaned under optimum conditions with the remaining toner T being prevented from returning to the belt 4, despite the use of carrier 33 whose volume resistivity is lower than $10^{10}$ Ω.cm. The researches and experiment showed that the dielectric constant of remaining toner T and toner t retained on the sleeve 31 beforehand has critical influence on whether or not the toner adhered to the carrier returns to the belt 4. More specifically, by adequately selecting the dielectric constant of toner particles, it is possible to eliminate the return of the toner from the carrier to the toner despite the use of carrier whose resistance is lower than $10^{10}$ Ω.cm.

Figure 5:
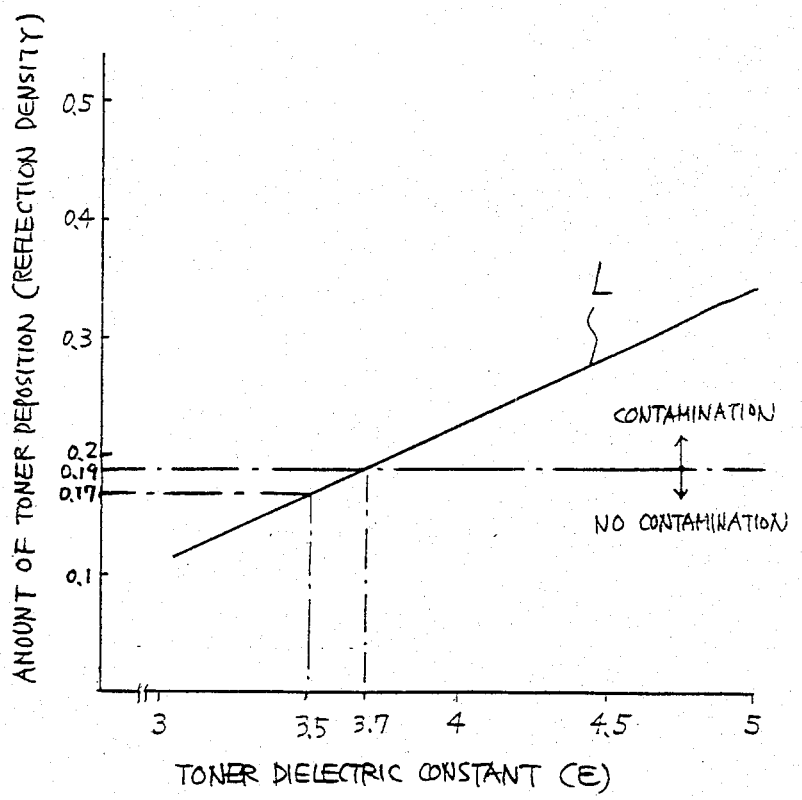
FIG. 5 is a graph useful for understanding the principle of the present invention.

FIG. 5 is a graph exemplarily showing the experimental results. In the graph, the abscissa indicates the dielectric constant of toner used while the ordinate indicates, in terms of reflection density, the amount of toner which remains on the belt 4 after it has moved away from the cleaning device 28. The experimental procedure is as follows. A transparent transfer tape was adhered to an image forming area of the belt 4 which has moved away from the cleaning device 28 so as to transfer toner remaining on the belt 4 to the tape. Then, the tape was removed from the belt 4 and adhered to a white paper sheet, whereafter the reflection density is measured from above the tape by using a reflection densitometer which was a Macbeth densitometer Model RD514 available from Macbeth. Such a procedure was repeated with respect to different dielectric constants t of the toner T which is stored in the developing unit 18, resulting in the relationship represented by L in FIG. 5. The volume resistivity of the carrier used with the cleaning unit 28 was $10^6$ Ω.cm and maintained the same for every dielectric constant of toner. White paper sheets and transparent tapes used for the experiments had a reflection density value of 0.1 each. Hence, that the reflection density of the belt 4 coming out of the cleaning unit 28 is measured to be 0.1 implies that substantially no toner is present on the belt 4.

As shown in FIG. 5, the lower the dielectric constant of the toner t and T, the smaller the amount of toner remaining on that part of the belt 4 which has come out of the cleaning unit 28 becomes, i.e., the greater the cleaning ability becomes. It follows that the use of toner having a small dielectric constant is successful in suppressing the return of toner T transferred to the carrier on the sleeve 31 or toner t retained on the sleeve 31 beforehand to the belt 4. Hence, two advantages are achieved at the same time: enhancing the cleaning efficiency due to the use of low resistance carrier (less than $10^{10}$ Ω.cm), and reducing the toner which may be returned from the carrier to the belt 4 so as to enhance the quality of a toner image which will be formed next.

It has been found that in the actual use of the copier the background of a toner image to be formed next is free from contamination so long as the reflection density on the belt 4 which has come out of the cleaning device 28 is lower than 0.019. The dielectric constant of toner capable of regulating the reflection density to lower than 0.019 as mentioned is smaller than 3.7, as seen from FIG. 5. In this respect, the present invention proposes a construction which uses toner the particles of which have a dielectric constant of smaller than 3.7. It will be clear from FIG. 5 that the use of toner having a dielectric constant of smaller than 3.5 is especially desirable because it is effectively restrained from being returned from the carrier to the belt 4 and suppresses the reflection density on the belt 4 to less than 0.17.

In summary, it will be seen that the present invention provides a cleaning device which efficiently removes remaining toner from an image carrier and preserves such a capability over a long period of time simply by using carrier particles whose volume resistivity is less than $10^{10}$ Ω.m and toner whose dielectric constant is less than 3.7.

Various modifications will become possible for those skilled in the art after receiving the teachings of the present disclosure without departing from the scope thereof. For example, while a cleaning sleeve has been shown and described as being rotatable relatve to magnets, the magnets may be rotated within the cleaning sleeve which is stationary or both of the magnets and the sleeve may be rotated relative to each other. It will be apparent that the present invention is similarly applicable to an image forming apparatus having a photoconductive element in the form of a drum or an image carrier which is implemented by a dielectric material. In such an alternative application, the polarity to which the photoconductive element or the image carrier is charged, the polarity to which toner is charged during development, and the polarity of bias voltage applied to individual sleeves may of course be changed depending upon the property of the image carrier used. When the photoconductive element is implemented by selenium, for example, the photoconductive element will be positively charged by a charger while the toner will be negatively charged during development. In this instance, remaining toner may be charged, for example, to the negative polarity by a precleaning charger with a positive voltage being applied to each sleeve.

Further, the cleaning sleeve which serves as a carrier retaining member may be replaced with a belt, for example. If desired, a plurality of carrier retaining members are located to face an image carrier so as to remove remaining toner from the image carrier in cooperation.

What is claimed is:

1. In a cleaning device for an image forming apparatus which develops an electrostatic latent image formed on an image carrier with toner to produce a toner image, transfers said toner image to a transfer material, and cleans said image carrier to remove toner remaining on said image carrier after the image transfer, said cleaning device comprising a carrier retaining member magnetically retaining carrier which forms a magnet brush and being located to face said image carrier such that said carrier attracts by an electric force the toner remaining on said image carrier, and voltage applying means for applying to said carrier retaining means a bias voltage which is opposite in polarity to a charge deposited on the remaining toner to be removed, the improvement wherein particles of the carrier which forms the magnet brush individually have volume resistivity of lower than $10^{10}$ Ω.cm while particles of the toner individually have a dielectric constant of smaller than 3.7.

2. A cleaning device as claimed in claim 1, wherein the volume resistivity of the carrier particles lies in a range of $10^6$ Ω.cm to $10^{10}$ Ω.cm.

3. A cleaning device as claimed in claim 1, wherein the volume resistivity of the carrier particles lies in a range of $10^6$ Ω.cm to $10^8$ Ω.cm.

4. A cleaning device as claimed in claim 1, wherein the dielectric constant of the toner particles is selected to be smaller than 3.5

5. A cleaning device as claimed in claim 1, wherein said carrier retaining member comprises a rotatable sleeve and a plurality of magnets which are disposed in said sleeve.

6. A cleaning device as claimed in claim 5, further comprising a toner collecting roller disposed to face said sleeve of said carrier retaining member for electrically collecting the remaining toner which is adhered to the carrier which is retained on said sleeve.

7. A cleaning device as claimed in claim 6, wherein a bias voltage is applied to each of said toner collecting roller and said sleeve to develop an electric field which is variable in intensity.

8. A cleaning device as claimed in claim 7, wherein the intensity of the electric field is changed to cause a part of the remaining toner adhered to the carrier which is retained on said sleeve to be left on said carrier without being collected by said toner collecting roller.

9. A cleaning device as claimed in claim 7, wherein the bias voltage applied to said toner collecting roller is higher than the bias voltage applied to said sleeve.

10. A cleaning device as claimed in claim 1, wherein the remaining toner is uniformly charged before said toner is removed from said image carrier.

* * * * *